US011002264B2

(12) United States Patent
Komiya et al.

(10) Patent No.: US 11,002,264 B2
(45) Date of Patent: May 11, 2021

(54) PORTABLE INFLATOR

(71) Applicant: MAKITA CORPORATION, Anjo (JP)

(72) Inventors: Kosuke Komiya, Anjo (JP); Noriyuki Nishido, Anjo (JP); Kento Nakamura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 99 days.

(21) Appl. No.: 16/442,847

(22) Filed: Jun. 17, 2019

(65) Prior Publication Data

US 2020/0011311 A1 Jan. 9, 2020

(30) Foreign Application Priority Data

Jul. 5, 2018 (JP) ..... JP2018-128452

(51) Int. Cl.
*F04B 35/04* (2006.01)
*F04B 35/06* (2006.01)

(52) U.S. Cl.
CPC ..... *F04B 35/04* (2013.01); *F04B 35/06* (2013.01)

(58) Field of Classification Search
CPC ..... F04B 35/04; F04B 35/06
See application file for complete search history.

(56) References Cited

U.S. PATENT DOCUMENTS 6,237,653 B1 * 5/2001 Chaffee ..... F04D 25/084 141/313
7,331,221 B2 * 2/2008 Wise ..... B60S 5/046 73/146.3
8,925,594 B2 * 1/2015 Ohm ..... F04B 35/06 141/38
2011/0113587 A1 * 5/2011 Nagasaka ..... A47L 5/14 15/339

FOREIGN PATENT DOCUMENTS

JP 2012112282 A 6/2012

* cited by examiner

*Primary Examiner* — Patrick Hamo
(74) *Attorney, Agent, or Firm* — J-TEK Law PLLC; Jeffrey D. Tekanic; Scott T. Wakeman

(57) ABSTRACT

A portable inflator (1) includes a motor (51), a compression mechanism (6) driven by the motor (51) to compress and discharge air, a main body housing (2), a leg (3), a grip (4), and a manually-operable trigger (41) provided on the grip. The main body housing (2) includes a battery mount part (251) for detachably mounting a battery (8), and houses the motor (51) and the compression mechanism (6). The leg (3) supports the main body housing (2) when a lower surface (31) of the leg (3) is disposed on a placement surface (P). The grip (4) is connected to the main body housing (2) and extends at least substantially parallel to the lower surface (31) of the leg (3). The motor (51) is driven in accordance with pulling of the trigger (41).

25 Claims, 4 Drawing Sheets

PORTABLE INFLATOR

CROSS-REFERENCE

The present application claims priority to Japanese patent application serial number 2018-128452 filed on Jul. 5, 2018, the contents of which are incorporated fully herein by reference.

TECHNICAL FIELD

The present invention generally relates to a portable inflator and, in some embodiments, further relates to a battery-operated (cordless) portable inflator.

BACKGROUND ART

Air compressors are known in which compressed air is supplied to a pneumatic tool, which is then driven by the compressed air. For example, Japanese Laid-open Patent Publication 2012-112282 discloses an air compressor that has been made compact to make it easier to carry it to various locations.

SUMMARY OF THE INVENTION

However, the air compressor of JP 2012-112282 is optimized solely for the purpose of supplying compressed air to a pneumatic tool. For example, the drive of a motor and the stopping thereof are appropriately controlled based on the set air pressure and the actual air pressure. On the other hand, objects to be supplied with compressed air are not limited to pneumatic tools and may be, for example, any of a variety of objects that may be, e.g., inflated, such as automobile tires, bicycle tires, balls, etc. Accordingly, there is a demand for a more general-purpose apparatus capable of supplying compressed air to a variety of objects.

Therefore, one non-limiting object of the present teachings is to provide a portable inflator that is capable of supplying compressed air to a variety of objects and that excels in ease of operation.

According to one aspect of the present teachings, a portable inflator comprises a motor, a compression mechanism, a main body housing, at least one leg, a grip (or handle), and an operation member (e.g., a switch, etc. for controlling operation of the motor, such as manually-operable motor control device). The compression mechanism is driven by the motor and is configured to compress air and to thereafter discharge the compressed air. The main body housing comprises a battery mount part (e.g., a battery cradle), onto which a battery (which serves as the power supply for the motor) is mountable and from which the battery is dismountable. In addition, the main body housing houses the motor and the compression mechanism. The at least one leg has a lower surface and is configured to support the main body housing when the lower surface is disposed on a placement surface, such as a horizontal or substantially horizontal surface. The grip is connected (e.g., integrally connected) to the main body housing. In addition, the grip (e.g., an upper surface and/or a lower surface of the grip and/or a central axis defining a longitudinal/extension direction of the grip) extends parallel or substantially parallel to the lower surface of the leg. The operation member is provided on the grip such that it is capable of being operated (manually manipulated) by a user. The motor is configured to be driven in accordance with operation (manual manipulation) of the operation member. For example, a trigger (e.g., a trigger switch) that is pulled (squeezed) by a user, a pushbutton switch that is pressed by a user, or the like can be given as representative, non-limiting examples of the operation member (or manually-operable motor control device) mentioned in the present aspect.

The portable inflator of the present aspect is a so-called placement-type inflator that is suited to being used by placing the lower surface of the at least one leg on the placement surface, e.g., a horizontal surface or substantially horizontal surface. Because the grip (e.g., an upper surface and/or a lower surface of the grip and/or a central axis defining a longitudinal/extension direction of the grip) extends parallel or substantially parallel (e.g., at an angle of 15° or less, more preferably 10° or less) to the lower surface of the leg when the inflator is placed on the placement surface, the user can grasp the grip in a natural posture that tends not to place a load or stress on the wrist. In addition, in the inflator of the present aspect, the compression mechanism discharges the compressed air when the operation member is manually operated (e.g., pressed or squeezed). Thereby, the user can, while verifying the state of the object (e.g., the inflation state of the object, the display of the actual air pressure, or the like), easily adjust the amount of compressed air supplied to the object (e.g., an object that is inflated) by operating (manipulating) the operation member (e.g., a motor control switch). Thus, according to the present aspect, it is possible to use the inflator to supply compressed air to multiple types of objects, such that the portable inflator excels in ease of operation.

According to another aspect of the present teachings, the main body housing may comprise a motor housing portion that houses the motor. Furthermore, the grip may be spaced apart and disposed upward of the motor housing portion such that the grip extends opposing (extends parallel or substantially parallel to) the motor housing portion. According to the present aspect, because the motor housing portion, which houses the comparatively heavy motor, is located downward of the grip, stability when the inflator is used by being placed on a placement surface can be improved. In addition, the user can operate the inflator by grasping the grip and applying a force downward, thereby further improving stability during operation of the inflator. It is noted that, in the present aspect, the grip is preferably disposed parallel or substantially parallel (e.g., at an angle of 15° or less, more preferably 10° or less) to the rotational axis of an output shaft of the motor and/or to the lower surface of the at least one leg. In this case, the motor housing portion and the grip can be arranged in a compact manner.

According to yet another aspect of the present teachings, the motor, the compression mechanism, and the battery mount part may be disposed downward of the grip. According to the present aspect, because the motor, the compression mechanism, and the battery mount part, which are heavy objects in the inflator, are all disposed downward of the grip, the center of gravity of the inflator when the battery is mounted is located lower than the grip. Thereby, stability when the inflator is being used by being placed on a placement surface can be further improved.

According to yet another aspect of the present teachings, the battery mount part may be configured such that the battery is mounted by being slid in the downward direction onto the battery mount part and is dismounted by being slid in the upward direction. According to the present aspect, even when the inflator is placed on the placement surface, the user can easily mount and dismount the battery.

According to yet another aspect of the present teachings, the main body housing may have an attachment opening for a hose that guides compressed air discharged from the compression mechanism to an object, such as an object to be inflated. In this embodiment of the present teachings, the attachment opening and the battery mount part may be provided on mutually opposite sides (ends) of the grip in the extension (front-rear) direction of the grip. According to the present aspect, even when the hose is attached to the attachment opening, the user can easily mount and dismount the battery without hinderance of the hose.

According to yet another aspect of the present teachings, the inflator may further comprise the hose. One end of the hose is connected to the attachment opening and is in fluid communication with the compression mechanism. Furthermore, the hose protrudes from the attachment opening in a direction that may be parallel or substantially parallel (e.g., at an angle of 15° or less, more preferably 10° or less) to the extension direction of the grip (or to the upper surface or the lower surface of the grip) or to the rotational axis of the motor. Thus, when the inflator is placed on the placement surface, the hose protrudes from the attachment opening parallel or at least substantially parallel to the placement surface and/or to the lower surface of the at least one leg. Consequently, routing (movement) of the hose, such as when connecting the hose to an object to be inflated, becomes easy.

According to yet another aspect of the present teachings, the inflator may comprise the hose and also a cover member. In this aspect, the cover member preferably at least partially (or completely) covers a base end portion (length) of the hose, which is exposed at (adjacent) the attachment opening. Thus, in the present aspect, the cover member can prevent or impede the base end portion of the hose from bending and/or from tending to deteriorate.

DETAILED DESCRIPTION OF EMBODIMENTS

Figure 1:
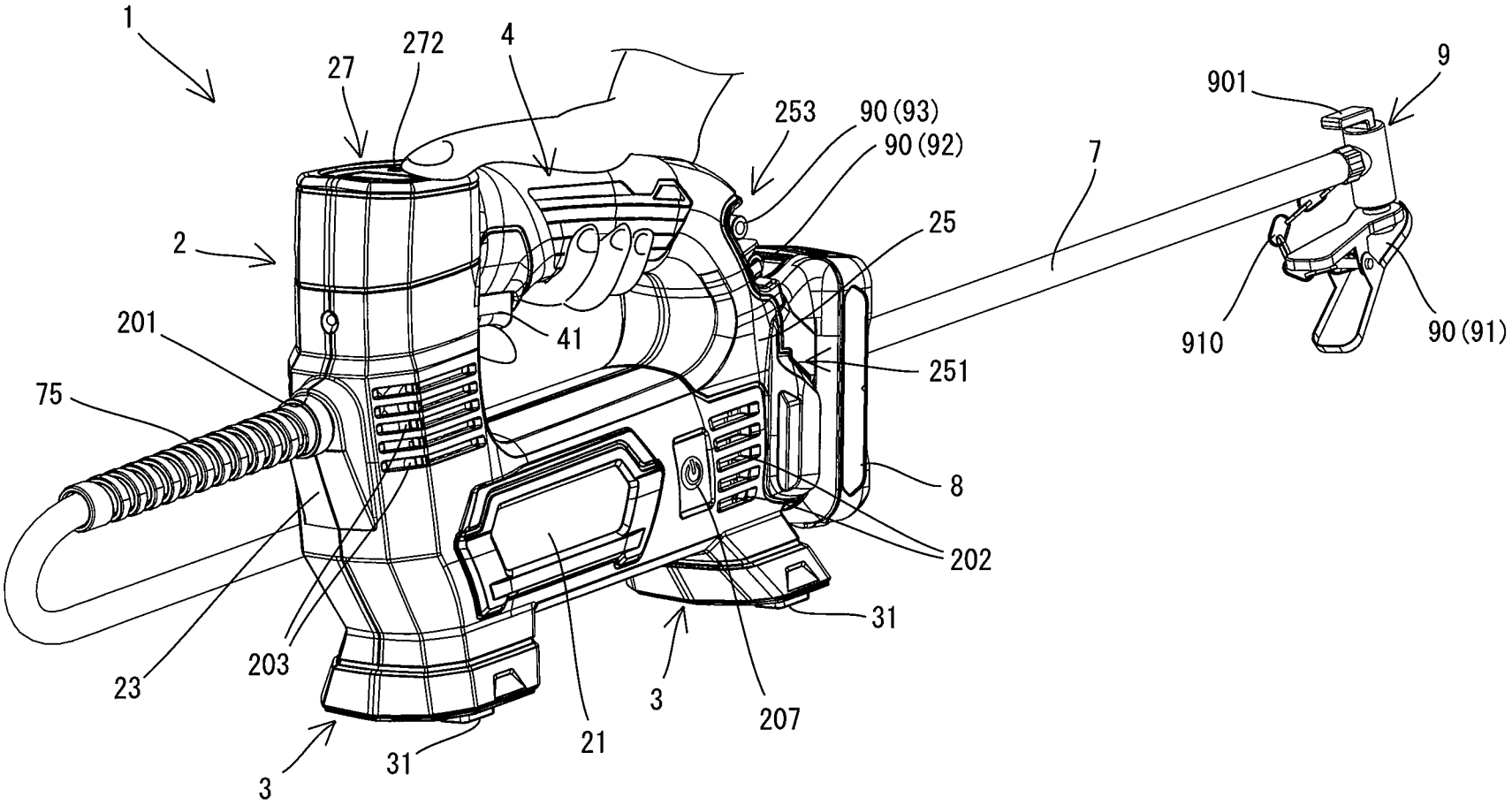
FIG. 1 is an overall oblique view of an inflator when a user has placed a finger on a trigger.

An inflator 1 according to a representative, non-limiting embodiment of the present teachings is explained below, with reference to the drawings. The inflator 1 shown in FIG. 1 is a portable power tool that is capable of supplying compressed air to multiple types of objects (e.g., to objects to be inflated) by selectively attaching one of a plurality of adapters 90 to a chuck (air chuck) 9 (e.g., for a basketball, soccer ball, etc. or some types of automobile or bicycle tires, etc.) or by directly attaching the chuck 9 to the object to be inflated (e.g., an automobile tire or a bicycle tire). Therefore, the tires of an automobile or a bicycle, sports balls (soccer balls, basketballs, volleyballs, and the like), and leisure articles that are used by being inflated (swim rings, beach balls, and the like) can be given as examples of objects to be supplied (inflated) with compressed air from the inflator 1.

First, the overall configuration of the inflator 1 will be explained, with reference to FIG. 1 and FIG. 2. The inflator 1 is configured on the assumption that it will be used by being placed on a placement surface P (e.g., the ground, a floor, or a tabletop; refer to FIG. 2) that is horizontal or substantially horizontal (e.g., at an angle of 25° or less relative to true horizontal). For the sake of convenience in the explanation below, the attitude of the inflator 1 when it is placed on the placement surface P, which is a flat horizontal surface in FIG. 2, serves as a reference system and defines the up-down direction of the inflator 1. That is, the side of the inflator 1 that is disposed on the placement surface P will be referred to as the lower side of the inflator 1, and the side spaced apart (upward) from the placement surface P will be referred to as the upper side of the inflator 1.

Figure 2:
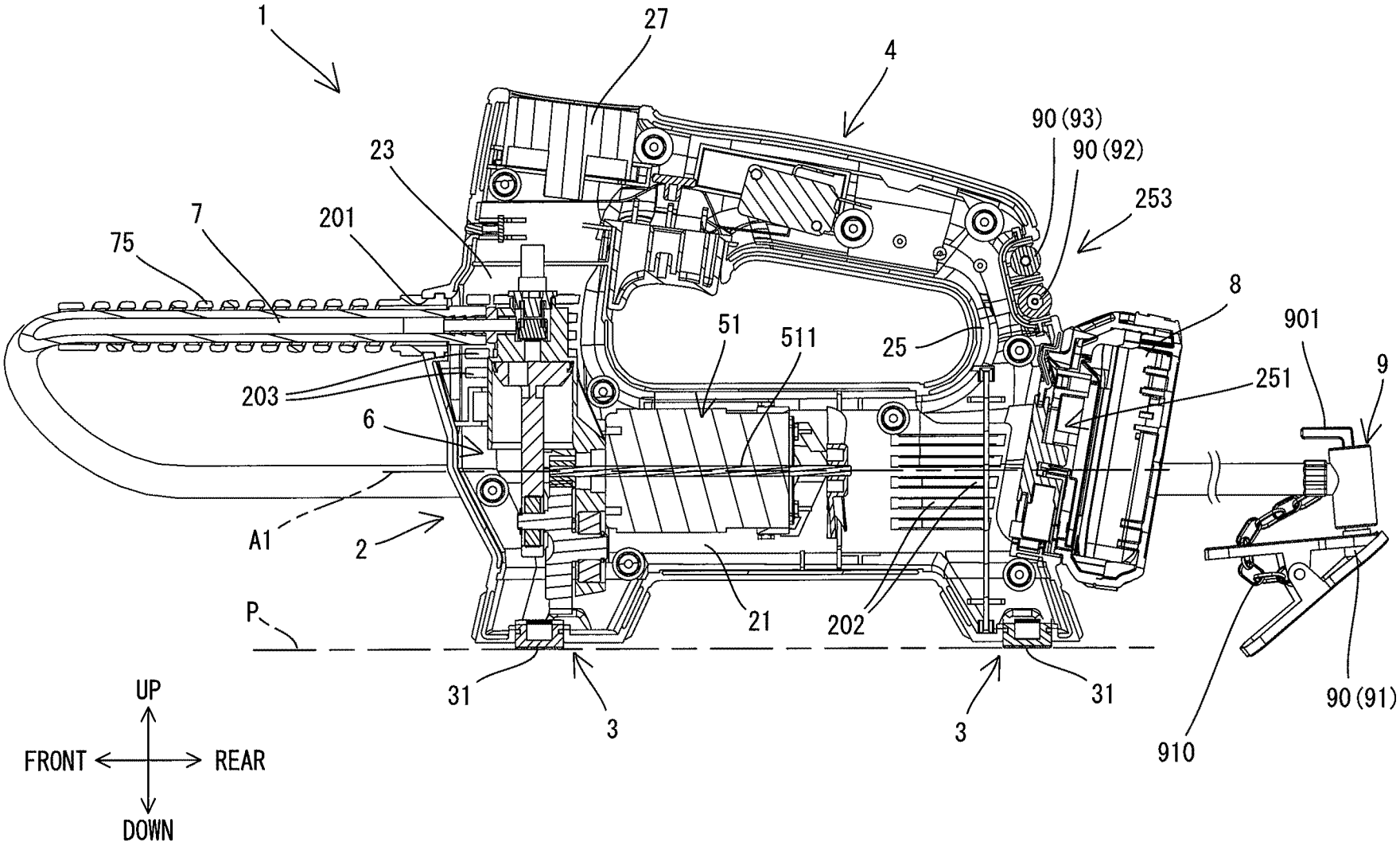
FIG. 2 is a cross-sectional view of the inflator.

As shown in FIGS. 1 and 2, the inflator 1 comprises a main body housing 2, two legs 3, a grip 4, and a hose 7. The main body housing 2 is configured as a casing (shell structure) that houses a motor 51, etc. (refer to FIG. 2). The legs 3 are disposed on the placement surface P and are configured to support the main body housing 2. In the present embodiment, the two legs 3 protrude downward from the main body housing 2. Each of the legs 3 is formed in a rectangular-box shape in cross-section and has a lower surface 31 disposed on the placement surface P. Within the main body housing 2, a base 21, which is the portion of the main body housing 2 that houses the motor 51, has an elongated tubular shape. The base 21 extends parallel or substantially parallel (e.g., at an angle of 10° or less, more preferably 5° or less) to the lower surfaces 31 (i.e., when the inflator 1 is placed on the placement surface P, the base 21 is at least substantially parallel to the placement surface P). An opening (attachment opening) 201 is provided in (at) one end of the main body housing 2 in the extension direction of the base 21. The opening 201 is configured as an opening for attaching the hose 7, which guides the compressed air, e.g., to the object to be inflated, and the hose 7 protrudes from the opening 201. Furthermore, a battery mount part (cradle) 251, onto which a battery 8, which serves as a power supply, can be mounted and from which it can be dismounted, is provided on the other (opposite) end of the main body housing 2 in the extension (front-rear) direction of the base 21.

The grip 4 is the portion intended to be grasped by the user when the inflator 1 is being carried and when compressed air is being supplied to an inflatable object. The grip 4 has an elongated tubular shape. The grip 4 is spaced apart from and is upward of the base 21, opposes the base 21, and extends parallel or at least substantially parallel to the base 21 (e.g., a lower surface of the grip 4 forms an angle of preferably 20° or less with the upper surface of the base 21, more preferably 15° or less). In addition, the grip 4 comprises a trigger (trigger switch) 41, which is configured to be pulled (depressed, squeezed) by the user in order to actuate the motor 51. When the hose 7 is connected to an object to be inflated and the trigger 41 is pulled, compressed air is supplied to the object through the hose 7 and the chuck 9 attached at the end of the hose 7.

The configuration of the inflator 1 is explained in greater detail below. It is noted that, for the sake of convenience in the explanation below, the front-rear direction of the inflator 1 is defined as the direction that is orthogonal to the up-down direction and generally corresponds to the extension direction of the grip 4 and/or to the extension direction of the base 21. In addition, the side on which the hose 7 is attached (the side of the attachment opening 201) is defined as the front side; and the side on which the battery 8 is mounted (the side of the battery mount part 251) is defined as the rear side. Finally, the direction that is orthogonal to the up-down direction and to the front-rear direction is defined as the left-right direction.

First, the main body housing 2 and its internal structure will be explained. As shown in FIGS. 1 and 2, the main body housing 2 has a substantially U-shape overall and comprises the base 21, a front-side extension part 23, and a rear-side extension part 25.

As described above, the base 21 is the portion of the main body housing 2 that extends in the front-rear direction. The front-side extension part 23 and the rear-side extension part 25 are connected to a front-end portion and a rear-end portion, respectively, of the base 21 and each extends in the up-down direction. The front-side extension part 23 and the rear-side extension part 25 both protrude upward from the base 21. A front-end portion and a rear-end portion of the grip 4 are respectively connected to upper-end parts of the front-side extension part 23 and the rear-side extension part 25. As a result, the main body housing 2 and the grip 4 together form a substantially D-shaped loop in side view. In addition, the two legs 3 protrude downward from lower-end portions of the front-side extension part 23 and the rear-side extension part 25, respectively. It is noted that, in the present embodiment, the main body housing 2, the legs 3, and the grip 4 are integrally formed by joining (fastening) left and right housing halves together, wherein each housing half integrally connects a half of the main body housing 2, a half of each of the legs 3 and a half of the grip 4.

Figure 3:
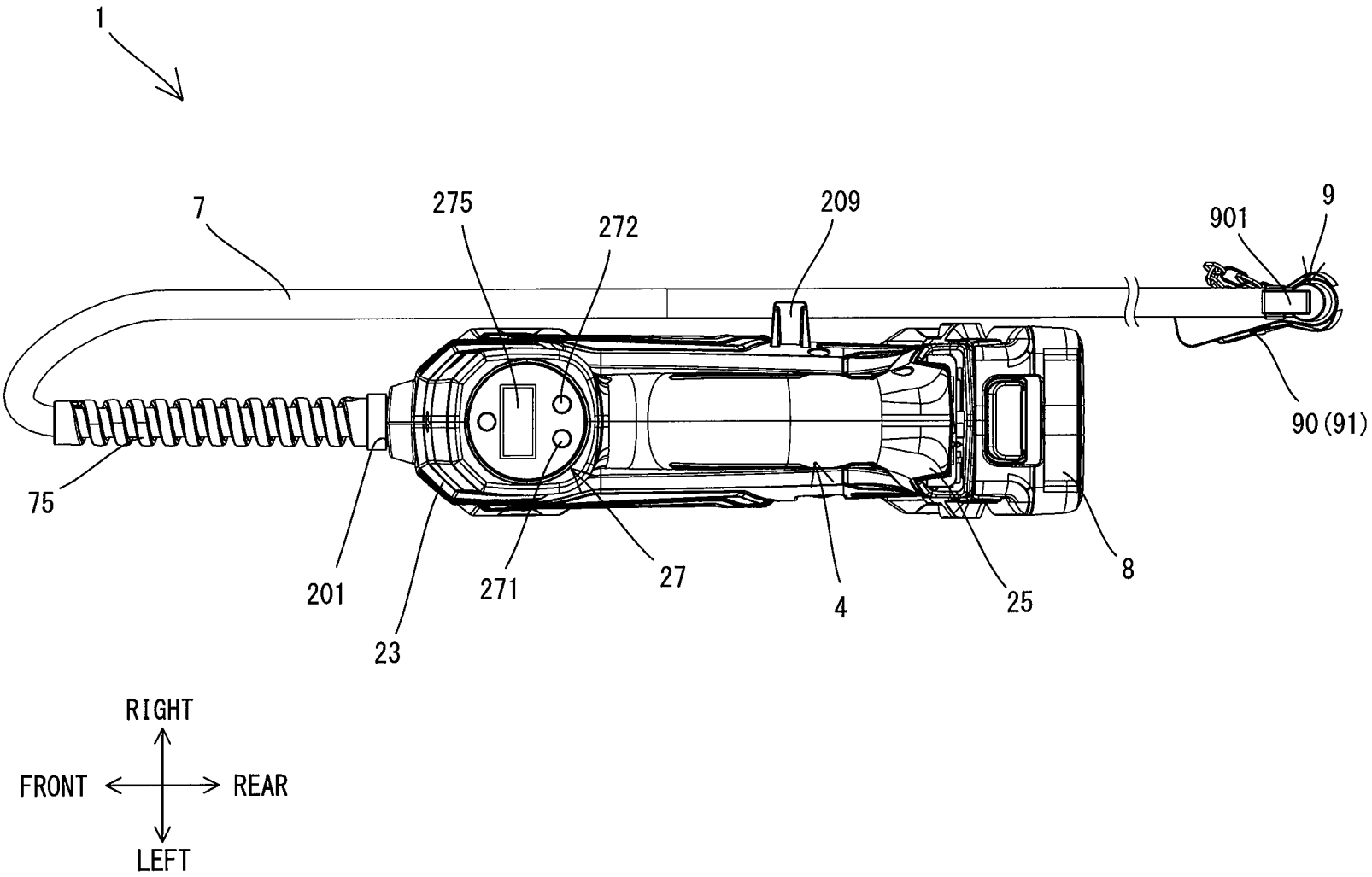
FIG. 3 is a top view of the inflator.

Vents, which enable fluid (gaseous) communication between the interior and the exterior of the main body housing 2, are provided in the main body housing 2. In greater detail, a plurality of air-suction ports 202 is provided in left and right side surfaces of the main body housing 2 in the region extending from the rear-end portion of the base 21 to the lower-end portion of the rear-side extension part 25. In addition, a plurality of air exhaust ports 203 is provided in left and right side surfaces of a center part, in the up-down direction, of the front-side extension part 23. Furthermore, a main power switch (ON/OFF switch) 207 is provided on a left-side surface of the rear-end portion of the base 21. As shown in FIG. 3, a hose holder 209 is provided on a right-side surface of the base 21.

Figure 4:
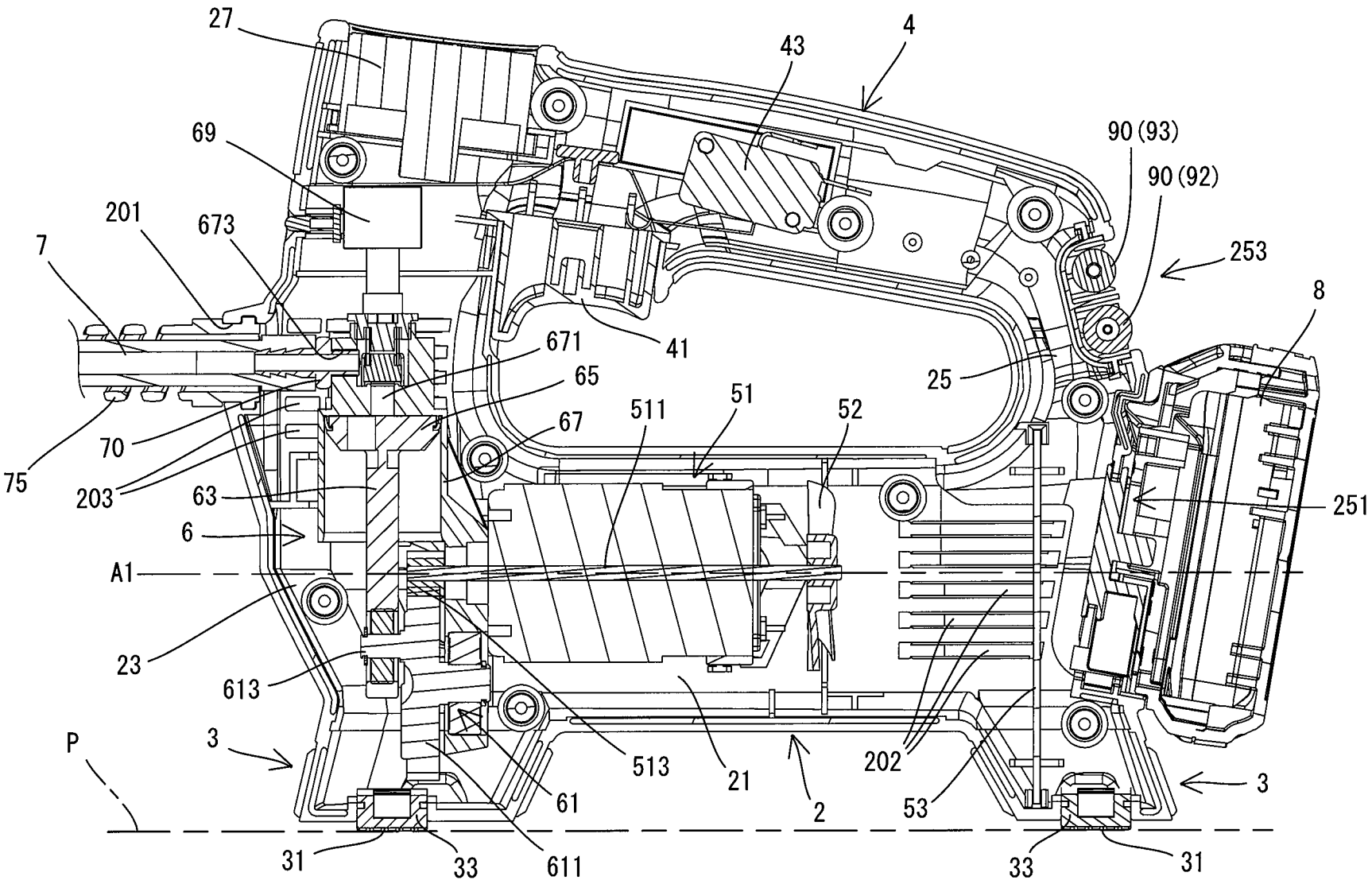
FIG. 4 is a partial enlarged view of FIG. 2 with a portion of the hose omitted.

As shown in FIG. 4, the motor 51 is housed inside the base 21. In greater detail, the motor 51 is disposed in a front-side portion of the base 21. In addition, the rotational axis A1 of a motor shaft 511 extends in the front-rear direction and parallel (or at least substantially parallel, such as at an angle of 5° or less) to the lower surfaces 31 of the legs 3. The front-end portion of the motor shaft 511 protrudes into the front-side extension part 23. A drive gear 513 is fixed to the front-end portion of the motor shaft 511. A fan 52 is fixed to the rear-end portion of the motor shaft 511 (the rear side of a main body part (stator and rotor) of the motor). The fan 52 rotates integrally with the motor shaft 511 as the motor 51 is driven.

A compression mechanism 6 is housed in a lower-side portion of the front-side extension part 23. The compression mechanism 6 is a mechanism (also called an air pump) that is driven by the motor 51 and is configured to compress air and then discharge the compressed air. In the present embodiment, the compression mechanism 6 principally comprises a crankshaft 61, a coupling rod 63, a piston 65, and a cylinder 67. Because the configuration of a compression mechanism 6 of this type is well known, it is explained briefly in the following.

The crankshaft 61 comprises a crank disk 611 and an eccentric pin 613. Gear teeth, which engage with the drive gear 513, are formed on an outer circumference of the crank disk 611. It is noted that the rotational axis of the crankshaft 61 extends downward of and parallel to the rotational axis A1 of the motor shaft 511. The eccentric pin 613 is provided at a location that is eccentric (offset) with respect to the rotational axis of the crankshaft 61 and protrudes forward from the crank disk 611. The coupling rod 63 is disposed such that it extends substantially in the up-down direction. The lower-end portion of the coupling rod 63 is coupled to the eccentric pin 613 such that the eccentric pin 613 can pivot within a hole defined in the coupling rod 63 while the eccentric pin 613 is orbiting about the rotational axis A1 of the crankshaft 61. The piston 65 is integrally provided on the upper-end portion of the coupling rod 63. Consequently, the piston 65 will reciprocally move in the up-down direction when the eccentric pin 613 is rotated about the rotational axis A1.

The cylinder 67 is fixed inside the center part of the front-side extension part 23, and the piston 65 is slidable up and down inside the cylinder 67. A compression chamber 671 is formed at an upper side of the piston 65. A discharge port 673 for discharging compressed air from the compression chamber 671 to the exterior opens in the forward direction. The opening 201 of the main body housing 2 opposes the front side of the discharge port 673.

In addition, as shown in FIGS. 3 and 4, an operation part 27 is provided on the upper-end portion of the front-side extension part 23. The operation part 27 comprises operation buttons 271, 272, a display 275, and a not-shown control part (that may also be called a control circuit or controller, which may include a microprocessor, RAM, ROM, software for operating the inflator 1, etc.). The operation buttons 271, 272 are provided for setting a target air pressure and are pressed to increase or decrease the target air pressure that is being set. The display 275 displays the target air pressure and the actual air pressure of the compressed air inside the compression chamber 671. It is noted that a pressure sensor 69 that detects the actual air pressure inside the compression chamber 671 is provided at an upper side of the compression chamber 671 (between the compression chamber 671 and the operation part 27). The control part of the operation part 27 is electrically connected to the operation buttons 271, 272, the display 275, the pressure sensor 69, and a control part (controller) 53 of the motor 51. The control part of the operation part 27 causes the target air pressure that was set in accordance with the operation (pressing) of the operation buttons 271, 272 to be displayed on the display 275. In addition, the control part of the operation part 27 also causes the actual air pressure, which is detected by the pressure sensor 69 while the motor 51 is being driven, to be displayed on the display 275. Furthermore, when the actual air pressure has reached the target air pressure, the control part of the operation part 27 outputs a predetermined signal to the control part 53 of the motor 51 in order to stop the operation (driving) of the motor 51.

As shown in FIG. 4, the battery mount part 251 is provided at (on) a rear end of the lower-side portion of the rear-side extension part 25. In greater detail, the battery mount part 251 is disposed at the rear side of the motor 51 along the rotational axis A1 of the motor shaft 511. The battery mount part 251 of the present embodiment has a well-known configuration and is designed so that the rechargeable battery 8 is mountable thereon and is dismountable (removable) therefrom.

In brief, the battery mount part 251 comprises a pair of guide rails, a hook-engaging part, and contact terminals. The pair of guide rails is configured to be capable of engaging, by sliding, with a pair of guide grooves provided on the battery 8. It is noted that, in the present embodiment, the guide rails are respectively provided on a left-rear end and a right-rear end of the rear-side extension part 25 and extend in the up-down direction. The hook-engaging part is provided (designed), on an upper part of the battery mount part 251, as a recessed part (recess) that is capable of engaging with a hook, which is provided in a retractable manner on the battery 8. Owing to this configuration, the battery 8 is mounted on the battery mount part 251 by being slid in the downward direction and is dismounted from the battery mount part 251 by being slid in the upward direction. It is noted that, when the battery 8 is slid in the downward direction to a prescribed position, the hook automatically engages with the hook-engaging part, the contact terminals of the battery 8 and the contact terminals of the battery mount part 251 become electrically connected, and thereby the mounting is completed.

In addition, an adapter holder 253 is provided (defined) on the rear-side extension part 25 upward of the battery mount part 251. As described above, to operate the inflator 1 of the present embodiment, one adapter (or needle) selected from among the multiple types of adapters 90 (for example, a tire valve adapter 91 (such as an English valve adapter, a Shrader valve adapter or a Presta valve adapter), a sports ball valve adapter (needle) 92, and a leisure-article adapter (tapered adapter) 93) may be mounted in the chuck 9 (or in some applications of the present teachings, the chuck 9 may be directly attached to a valve stem, e.g., of an automobile or bicycle tire without an adapter). The tire valve adapter 91 may be connected to the hose 7 by a chain 910, rather than being held in the adapter holder 253. Therefore, the adapter holder 253 is configured such that it has two recessed parts in which the sports ball adapter (needle) 92 and the leisure-article adapter (tapered adapter) 93 may be respectively engaged.

Next, the legs 3 will be explained. As shown in FIG. 4, the two legs 3 respectively extend downward from a lower-front end portion and a lower-rear end portion of the main body housing 2 (in greater detail, from the lower-end portions of the front-side extension part 23 and the rear-side extension part 25). It is noted that the lower-end portion of the compression mechanism 6 (e.g., a portion of the crank disk 611) is disposed in the (hollow) interior of the front-side leg 3. Owing to this configuration, the overall height of the main body housing 2 in the up-down direction can be reduced, as compared with an embodiment in which the entire compression mechanism 6 is housed inside the main body housing 2. In addition, elastic members 33, which are made of an elastomer, are mounted on bottom parts of the legs 3. In the present embodiment, the lower surfaces of the elastic members 33 constitute the lower surfaces 31 that are designed to be disposed on the placement surface P.

The grip 4 and the internal structure thereof will now be explained. As shown in FIG. 4, the grip 4 is connected (e.g., integrally connected) to the upper-end portions of the front-side extension part 23 and the rear-side extension part 25 and extends at least substantially parallel (i.e., substantially in the front-rear direction) to the base 21. Thus, the motor 51, the compression mechanism 6, and the battery mount part 251 are located downward of the grip 4. It is noted that, when the battery 8 is mounted on the battery mount part 251, the battery 8 is also located downward of the grip 4. That is, in the inflator 1, the motor 51, the compression mechanism 6, and the battery 8, which are comparatively heavy, are all disposed downward of the grip 4. Owing to such an arrangement, the center of gravity of the inflator 1 is located downward of the grip 4 when the battery 8 is mounted on the battery mount part 251, i.e. the center of gravity is located below the bottom surface of the grip 4 and above the lower surface of the at least one leg 3 in the vertical (up-down) direction of the inflator 1 that has been set on a horizontal surface.

The trigger 41 is held by a front-lower-end part of the grip 4 such that it is capable of moving in the up-down direction. The trigger 41, in an (its) initial state, is disposed at a position (also called the initial position) at which it protrudes maximally downward from the grip 4 owing to the biasing force of a not-shown biasing member (e.g., a compression-coil spring), and is moved upward when the trigger 41 is pulled (depressed, squeezed) by the user. A switch 43 is housed in the interior of the grip 4. When the trigger 41 is pulled and moved from its initial position to a prescribed position (also called the ON position), the switch 43 switches from an OFF state to an ON state. The switch 43 is electrically connected to the control part 53 of the motor 51.

In the present embodiment, the length of the grip 4 in the front-rear direction is set to a length suited to the size of the average hand of an adult male. In addition, the diameter of the grip 4 is made as small as possible while ensuring that the grip 4 is still able (has sufficient internal volume) to house the switch 43. Furthermore, as shown in FIG. 1, when the user has grasped the grip 4 and placed his or her index finger on the trigger 41, the operation buttons 271, 272 of the operation part 27 described above are disposed at locations at which they can be operated using (are reachable by) the user's thumb. Thus, the grip 4 is optimally (ergonomically) configured taking into consideration the operation of the trigger 41 while the grip 4 is being grasped.

The hose 7 will now be explained. As shown in FIG. 4, a connector 70 is attached to one end of the hose 7. The hose 7 is connected to the discharge port 673 of the compression mechanism 6 via the connector 70. As shown in FIGS. 1 2, the hose 7 passes through the opening 201 (attachment opening) of the main body housing 2 and is led out forward from the main body housing 2. A base end portion of the hose 7, which is exposed at the opening 201 to the exterior of the main body housing 2, is covered (at least partially covered) by a cover member 75. In the present embodiment, the cover member 75 is made of a resin material, is formed into a helical shape, and permits a certain extent of expansion and contraction and bending. It is noted that the hose 7 is flexible and therefore the user can freely bend it. However, the base end portion of the hose 7 is held, by the cover member 75, when it protrudes substantially forward from the opening 201. When storing the inflator 1, the user can cause the hose 7 to be held by the hose holder 209 (refer to FIG. 3), which is provided on the right-side surface of the base 21. It is noted that the hose holder 209 has projections that are disposed opposing one another in the up-down direction and is configured so as to hold the hose 7 by sandwiching (elastically clamping) the hose 7 between the projections.

The chuck 9, which is capable of engaging (being attached to), e.g., a tire valve of an automobile or bicycle, with or without a tire adapter is affixed to a tip portion (a terminal end) of the hose 7. The chuck 9 comprises a lever (clamp) 901 that is capable of pivoting between a locked position (the position shown in the drawings) and an unlocked position (not shown). When the lever 901 is disposed at (in) the unlocked position, the user can fix the chuck 9 to the valve by causing the chuck 9 to engage with the tire valve of the automobile, bicycle, etc. and then pivoting the lever 901 to the locked position. In addition, the chuck 9 is also capable of engaging (holding) one of the adapters 90. By operating the lever 901 in a similar manner, the user can use any appropriate adapter 90 by mounting it in the chuck 9 in accordance with the object to be supplied (filled, inflated) with the compressed air.

A representative, non-limiting method for operating the inflator 1 is explained below. In the present embodiment, when the trigger 41 is pulled and moved to the ON position and the switch 43 changes to the ON state, the control part 53 of the motor 51 drives the motor 51 by supplying electric current to the motor 51. It is noted that, when the main power switch 207 is in the OFF state, the control part 53 of the motor 51 does not drive the motor 51 even if the trigger 41 is pulled. That is, the control part 53 can drive the motor 51 only when the main power switch 207 is in the ON state and the trigger 41 is pulled (and, in some embodiments, when the control part of the operating part 27 has not sent a stop signal to the control part 53, because the target pressure has been reached, as will be further discussed below).

When the motor 51 is driven, the motor shaft 511, together with the fan 52 and the drive gear 513, is rotated. Thereby, air flows through the air-suction ports 202 and into the main body housing 2. In addition, the crankshaft 61 is rotated by the drive gear 513. When the eccentric pin 613 revolves (orbits) about the rotational axis of the crankshaft 61, the piston 65, which is fixed to the upper-end portion of the coupling rod 63, reciprocatively moves up and down inside the cylinder 67. Owing to this reciprocating motion of the piston 65, air is suctioned into the cylinder 67 and then compressed and discharged in a repetitive manner. It is noted that some of the air that flows into the main body housing 2 is sucked into the compression mechanism 6, and the remainder flows around the compression mechanism 6 and is discharged via the air exhaust ports 203. The airflow from the air-suction ports 202 to the air exhaust ports 203 functions as a cooling draft that cools the motor 51 and the compression mechanism 6.

The air compressed by the compression chamber 671 (the compressed air) is led into the hose 7, which is connected to the discharge port 673, and is supplied to an object (e.g., to an object to be inflated) via the chuck 9 and optionally also via the adapter 90. When the trigger 41 is released and the switch 43 changes to the OFF state, the control part 53 of the motor 51 stops the drive of (the supply of electric current to) the motor 51. It is noted that, as described above, it is possible for the user to set the target air pressure using the operation buttons 271, 272 in the present embodiment. If the control part 53 of the motor 51 receives, from the control part of the operation part 27, a specific signal (motor drive stop signal) indicating that the actual air pressure detected by the pressure sensor 69 has reached the target air pressure, then the control part 53 stops the drive of the motor 51, even if the switch 43 is in the ON state. That is, in the present embodiment, the control part 53 of the motor 51 is configured to stop the drive of the motor 51 either when the switch 43 has been switched to the OFF state or when the actual air pressure has reached the target air pressure, even if the main power switch 207 is in the ON position.

As explained above, the inflator 1 of the present embodiment is a so-called placement-type inflator that is suited to being used by placing the lower surfaces 31 of the legs 3 on the placement surface P. Because the grip 4 extends substantially parallel to the lower surfaces 31, the grip 4 is substantially parallel to the placement surface P when the inflator 1 is placed on the placement surface P. Thereby, the user can grasp the grip 4 in a natural posture that tends not to place a load on the wrist. In addition, in the inflator 1, the compression mechanism 6 discharges the compressed air in accordance with the pulling of the trigger 41 (the ON state of the switch 43). Thereby, the user can, while verifying the state of the object (e.g., the inflation state of the object, the actual air pressure displayed on the display 275, and the like), easily adjust the amount of compressed air supplied by appropriately pulling and releasing the trigger 41. That is, when the user starts the supply of compressed air to the object to be inflated by pulling the trigger 41 and then determines that an appropriate amount of compressed air has been supplied to the object, the user merely needs to release the trigger 41. Thus, according to the present embodiment, because it is possible to use the inflator to supply compressed air to multiple types of objects, a portable inflator that excels in ease of operation is provided.

Furthermore, in the inflator 1 of the present embodiment, the user can set the desired target air pressure using the operation part 27. In this case, when the air pressure of the compressed air detected by the pressure sensor 69 has reached the target air pressure, the control part 53 of the motor 51 stops the drive of the motor 51 regardless of the pulling (operation state) of the trigger 41 (i.e., even if the switch 43 is in the ON state). Therefore, when the inflator 1 is used to inflate an automobile tire, the inflator 1 can be operated, by setting an appropriate target air pressure, to automatically stop the drive of the motor 51 when the target air pressure is reached. On the other hand, if the user uses the inflator 1 to inflate, for example, a bicycle tire, a ball, or a leisure article, then the user can adjust the amount of compressed air supplied by setting the target air pressure in advance to a pressure higher than necessary and then pulling and releasing the trigger 41 prior to reaching the set target air pressure, if desired. Thus, according to the inflator 1 of the present embodiment, because the user can select, in accordance with the object to be inflated, the method by which the drive of the motor 51 is stopped, the handiness (versatility) of the inflator 1 is improved. In another embodiment of the present teachings, the operation part 27 may be configured such that the user can turn off the target pressure setting, such that the inflator 1 operates solely based upon the pulling and releasing of the trigger 41 without regard to the detected air pressure of the object.

In the present embodiment, the grip 4 is spaced apart from and is upward of the base 21, which houses the motor 51, and extends opposing the base 21. Because the base 21, which houses the comparatively heavy motor 51, is located downward of the grip 4, stability when the inflator 1 is used by being placed on the placement surface P can be improved. Furthermore, the compression mechanism 6 and the battery mount part 251, which are heavy objects other than the motor 51, are also disposed downward of the grip 4. Owing to such an arrangement of the heavy parts of the inflator 1, the center of gravity of the inflator 1 when the battery 8 is mounted is set to a location that is lower than the grip 4, and consequently stability when the inflator 1 is being used can be further improved. In addition, according to the inflator 1 of the present embodiment, the user can operate the inflator 1 by grasping the grip 4, which extends substantially parallel to the placement surface P, and applying a force downward. In such a usage mode, stability during usage of the inflator 1 can be even further improved.

In the present embodiment, the battery mount part 251 is configured such that the battery 8 is mounted by being slid, in the downward direction, onto the battery mount part 251 and is dismounted (removed) by being slid, in the upward direction, from the battery mount part 251. Thereby, even when the inflator 1 is placed on the placement surface P, the user can easily mount and dismount the battery 8. Furthermore, the opening 201, which serves as the attachment opening of the hose 7, and the battery mount part 251 are provided on mutually opposite sides (ends) of the grip 4 (i.e., on the front side and the rear side, respectively) in the front-rear direction. Thereby, even when the hose 7 is attached, the user can easily mount and dismount the battery 8 without hindrance of the hose 7.

Furthermore, the hose 7 protrudes at least substantially parallel to the grip 4 and forward from the opening 201. Consequently, when the inflator 1 is placed on the placement surface P, the hose 7 protrudes from the opening 201 at least substantially parallel to the placement surface P. Thereby, the routing (movement) of the hose 7, such as when the chuck 9 of the hose 7 is connected to an object to be inflated, becomes easy. In addition, because the trigger 41 is provided on the front-end part of the grip 4, the user faces the forward direction of the inflator 1 when pulling the trigger 41. Because the hose 7 also protrudes in the same direction at this time, the work, which is performed while watching the hose 7 and the object connected via the hose 7, becomes easy.

Furthermore, the base end portion of the hose 7, which is exposed to the exterior of the main body housing 2 at the opening 201, is at least partially covered by the cover member 75. Thereby, the cover member 75 can prevent or impede the base end portion of the hose 7 from bending or tending to deteriorate. In addition, as described above, owing to the cooling draft that flows in from the air-suction ports 202 to the main body housing 2 and reaches the air exhaust ports 203, the compression mechanism 6 is effectively cooled. Furthermore, the temperature of the compressed air is higher at the base end portion of the hose 7, which is near the discharge port 673, than at the tip portion of the hose 7. Therefore, the cover member 75 serves to prevent (block) the user from directly touching the higher-temperature base end portion of the hose 7.

The above-mentioned embodiment is merely an illustrative example of the present teachings, and inflators according to the present invention are not limited to the exemplified configuration of the inflator 1 of the presently preferred embodiment described above. For example, the modifications exemplified below can be added. It is noted that any one of these modifications can be utilized alone or a plurality of these modifications can be utilized in combination with the inflator 1 described in the embodiment or the subject matter recited in the claims.

For example, the shapes of the main body housing 2, the legs 3, and the grip 4 may be modified as appropriate. For example, the main body housing 2, the legs 3, and the grip 4 do not have to be formed integrally and instead may be formed separately and coupled to one another. The legs 3 are not limited to having their lower surfaces disposed on the placement surface P and to being capable of supporting the main body housing 2 and do not have to be portions that can be differentiated from the main body housing 2, as exemplified in the above-mentioned embodiment. For example, the lower-end part (surface) of the main body housing 2 may constitute a leg. In addition, in the above-mentioned embodiment, the elastic members 33, which serve as slip preventers and cushions and have the lower surfaces 31, are provided on the legs 3; however, the elastic members 33 may be omitted, or a configuration may be used in which the lower surfaces of the legs 3 are placed on the placement surface P.

In the above-mentioned embodiment, the trigger 41 is used as an operation member (manually-operable switch) for driving the motor 51; however, instead of the trigger 41, for example, a momentary pushbutton switch (a switch that changes to the ON state only while being pressed) may be used. In this case, for example, the pushbutton switch is preferably provided, on the upper part of the grip 4, such that it is capable of being pressed by the palm, the thumb, or the like while the user grasps the grip 4. In particular, if it is possible to press such a pushbutton switch using the palm, the motor 51 can be driven merely by grasping the grip 4 while applying a downward force. In such an embodiment as well, stability during usage of the inflator 1 can be even further improved.

In addition, the configuration, arrangement, and location of the motor 51, the compression mechanism 6, and the battery mount part 251 may be modified as appropriate. For example, a brushless motor may be used as the motor 51. The type of the compression mechanism 6 is not limited to the reciprocating type exemplified in the above-mentioned embodiment. For example, instead of single-stage reciprocating compressor such as the present embodiment, the compressor mechanism 6 may be embodied as a two-stage reciprocating compressor, a compound compressor, a rotary-screw compressor, a rotary vane compressor, a scroll compressor, a turbo compressor or a centrifugal compressor. The battery mount part 251 may be configured such that the battery 8 is mounted and dismounted by being slid in the left-right direction.

In the above-mentioned embodiment, the hose 7 is joined to the main body housing 2 with one end portion of the hose 7 being connected to (in fluid communication with) the compression mechanism 6 via the opening 201. Nevertheless, the hose 7 may instead be configured such that it is capable of being mounted onto and dismounted from the main body housing 2 and the compression mechanism 6. The cover member 75 of the hose 7 may be configured such that it completely covers the base end portion of the hose 7 instead of having a helical shape that includes a helically-extending gap.

In the above-described exemplary embodiment, the inflator 1 comprises the operation part 27 for setting the target air pressure. Thus, the drive of the motor 51 may be automatically stopped when the actual (measured) air pressure reaches the target air pressure. Nevertheless, such control does not necessarily have to be performed. That is, as was briefly mentioned above, the drive of the motor 51 may be stopped in accordance only with the releasing of the trigger 41 (i.e., the changing of the switch 43 to the OFF state). In this case, the operation part 27, the pressure sensor 69, and the like may be omitted. Alternatively, the air pressure, which is detected by the pressure sensor 69, alone may be displayed on the display 275. In addition, a first mode, in which the drive of the motor 51 is stopped in accordance only with the release of the trigger 41, and a second mode, in which the drive of the motor 51 is stopped in accordance with the release of the trigger 41 and based on the target air pressure and the actual air pressure, may be selectable using the operation part 27. In addition, the operation device for setting the target air pressure is not limited to the push-type operation buttons 271, 272 and may be, for example, rotary dials.

The correspondence relationship between the structural elements of the present embodiment and the structural elements of the present teachings are described below. The inflator 1 is one representative, non-limiting example of an "inflator" of the present teachings. The motor 51, the motor shaft 511, and the rotational axis A1 are each one representative, non-limiting example of a "motor," an "output shaft," and a "rotational axis," respectively, of the present teachings. The compression mechanism 6 is one representative, non-limiting example of a "compression mechanism" of the present teachings. The main body housing 2 and the base 21 are each one representative, non-limiting example of a "main body housing" and a "motor housing portion," respectively, of the present teachings. The battery mount part 251 and the battery 8 are each one representative, non-limiting example of a "battery mount part" and a "battery," respectively, of the present teachings. The leg 3 (the elastic member 33) and the lower surface 31 are each one representative, non-limiting example of a "leg" and a "lower surface," respectively, of the present teachings. The grip 4 and the trigger 41 are each one representative, non-limiting example of a "grip" and an "operation member" or "manually-operable motor control device", respectively, of the present teachings. The opening 201, the hose 7, and the cover member 75 are each one representative, non-limiting example of an "attachment opening," a "hose," and a "cover member," respectively, of the present teachings.

Furthermore, the aspects below are constructed considering the gist of the present teachings and the above-mentioned embodiment. The aspects below can be used in combination with the inflator 1 described in the embodiment, the above-mentioned modified examples, and the subject matter recited in the claims.

[Aspect 1]

The operation member is configured such that it is capable of being pulled or pushed by a finger while the user is grasping the grip.

[Aspect 2]

The control part, which is configured to control the drive of the motor, is further provided; and the control part is configured to drive the motor only while the operation member is being pulled or pushed.

[Aspect 3]

The compression mechanism has a discharge port that discharges the compressed air; and the discharge port opposes the attachment opening in the extension direction of the grip.

[Aspect 4]

The compression mechanism and the battery mount part are disposed along the rotational axis of the output shaft.

[Aspect 5]

The center of gravity of the inflator when the battery is mounted on the battery mount part is located downward of the grip.

[Aspect 6]

Further provided are:

the setting-operation part for setting the target air pressure;

the pressure sensor, which is configured to detect the air pressure of the air compressed by the compression mechanism; and the control part, which is configured to control the drive of the motor; and the control part is configured to stop the drive of the motor in the case in which the operation of the operation member is released or in the case in which the air pressure detected by the pressure sensor has reached the target air pressure set via the setting-operation part.

It is noted that the operation part 27 (the operation buttons 271, 272) is one representative, non-limiting example of the "setting-operation part" in the present aspect. The pressure sensor 69 is one representative, non-limiting example of the "pressure sensor" in the present aspect. The control part 53 of the motor 51 is one representative, non-limiting example of the "control part" in the present aspect.

[Aspect 7]

In the case in which the extension direction of the grip is defined as the front-rear direction, the operation member is disposed on the front-end part of the grip; and the attachment opening is provided on the front-end part of the main body housing.

[Aspect 8]

With the user grasping the grip, the operation member and the setting-operation part are disposed at locations at which they can be operated by the index finger and the thumb, respectively.

[Aspect 9]

The hose is configured so as to be capable of being selectively connected to multiple types of objects via a plurality of mountable and dismountable adapter.

It is noted that the adapter 90 is one example of the "adapter" in the present aspect.

As used herein, the term "battery" is intended to encompass designs, in which a plurality of battery cells (e.g., lithium ion battery cells) are disposed within a hard resin case. Such batteries are also known as battery packs or battery cartridges.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved inflators, such as cordless (battery powered) inflators.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although some aspects of the present disclosure have been described in the context of a device, it is to be understood that these aspects also represent a description of a corresponding method, so that each block or component of a device, such as the control part(s) of the operating part 27 and/or the motor 51, is also understood as a corresponding method step or as a feature of a method step. In an analogous manner, aspects which have been described in the context of or as a method step also represent a description of a corresponding block or detail or feature of a corresponding device, such as the control part(s) of the operating part 27 and/or the motor 51.

Depending on certain implementation requirements, exemplary embodiments of the control part(s) of the operating part 27 and/or the motor 51 of the present disclosure may be implemented in hardware and/or in software. The implementation can be configured using a digital storage medium, for example one or more of a ROM, a PROM, an EPROM, an EEPROM or a flash memory, on which electronically readable control signals (program code) are stored, which interact or can interact with a programmable hardware component such that the respective method is performed.

A programmable hardware component can be formed by a processor, a computer processor (CPU=central processing unit), an application-specific integrated circuit (ASIC), an integrated circuit (IC), a computer, a system-on-a-chip (SOC), a programmable logic element, or a field programmable gate array (FGPA) including a microprocessor.

The digital storage medium can therefore be machine- or computer readable. Some exemplary embodiments thus comprise a data carrier or non-transient computer readable medium which includes electronically readable control signals which are capable of interacting with a programmable computer system or a programmable hardware component such that one of the methods described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the control part(s) of the operating part 27 and/or the motor 51, are implemented as a program, firmware, computer program, or computer program product including a program, or as data, wherein the program code or the data is operative to perform one of the methods if the program runs on a processor or a programmable hardware component. The program code or the data can for example also be stored on a machine-readable carrier or data carrier. The program code or the data can be, among other things, source code, machine code, bytecode or another intermediate code.

A program according to an exemplary embodiment can implement one of the methods during its performing, for example, such that the program reads storage locations or writes one or more data elements into these storage locations, wherein switching operations or other operations are induced in transistor structures, in amplifier structures, or in other electrical, optical, magnetic components, or components based on another functional principle. Correspondingly, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components, and thus for example also perform complex processes using the electric motor 11 and other mechanical structures of the power tool.

Therefore, although some aspects of the control part(s) of the operating part 27 and/or the motor 51 have been identified as "parts" or "units" or "steps", it is understood that such parts or units or steps need not be physically separate or distinct electrical components, but rather may be different blocks of program code that are executed by the same hardware component, e.g., one or more microprocessors.

EXPLANATION OF THE REFERENCE NUMBERS

1 Inflator
2 Main body housing
201 Opening
202 Air-suction port
203 Air exhaust port
207 Main power switch
209 Hose holder
21 Base
23 Front-side extension part
25 Rear-side extension part
251 Battery mount part
253 Adapter holder
27 Operation part
271 Operation button
272 Operation button
275 Display
3 Leg
31 Lower surface
33 Elastic member
4 Grip
41 Trigger
43 Switch
51 Motor
511 Motor shaft
513 Drive gear
52 Fan
53 Control part
6 Compression mechanism
61 Crankshaft
611 Crank disk
613 Eccentric pin
63 Coupling rod
65 Piston
67 Cylinder
671 Compression chamber
673 Discharge port
69 Pressure sensor
7 Hose
70 Connector
75 Cover member
8 Battery
9 Chuck
901 Lever
90 Adapter
91 Bicycle-tire adapter
910 Chain
92 Sports ball adapter (needle)
93 Leisure-article adapter
A1 Rotational axis
P Placement surface

We claim:

1. A portable inflator, comprising:

a motor;

a compression mechanism driven by the motor and configured to compress and discharge air;

a main body housing that comprises a battery mount part, onto which a battery that serves as a power supply for the motor is mountable and from which the battery is dismountable, the motor and the compression mechanism being housed in the main body housing;

at least one leg configured to support the main body housing when a lower surface of the at least one leg is disposed on a surface;

a grip connected to the main body housing and extending at least substantially parallel to the lower surface of the at least one leg; and a manually-operable motor control device provided on the grip;

wherein the motor is configured to be driven in accordance with manual operation of the manually-operable motor control device;

an attachment opening for a hose that guides compressed air discharged from the compression mechanism to an object to be inflated is provided on the main body housing; and the attachment opening and the battery mount part are located on opposite ends of the inflator in a front-rear direction that is parallel to a rotational axis of an output shaft of the motor.

2. The inflator according to claim 1, wherein:

the main body housing comprises a motor housing portion that houses the motor;

the grip is spaced apart from the motor housing portion and extends opposing the motor housing portion; and the motor housing portion is disposed between the grip and the lower surface of the at least one leg.

3. The inflator according to claim 2, wherein the grip is disposed at least substantially parallel to a rotational axis of the output shaft of the motor.

4. The inflator according to claim 3, wherein the motor, the compression mechanism, and the battery mount part are disposed between the grip and the lower surface of the at least one leg.

5. The inflator according to claim 4, wherein the battery mount part is configured such that the battery is mountable and removable by being slid in an up-down direction that is (i) orthogonal to the rotational axis of the output shaft of the motor and (ii) parallel to a line that intersects the grip and the motor.

6. A portable inflator, comprising:

a motor;

a compression mechanism driven by the motor and configured to compress and discharge air;

a main body housing that comprises a battery mount part, onto which a battery that serves as a power supply for the motor is mountable and from which the battery is dismountable, the motor and the compression mechanism being housed in the main body housing;

at least one leg configured to support the main body housing when a lower surface of the at least one leg is disposed on a surface;

a grip connected to the main body housing and extending at least substantially parallel to the lower surface of the at least one leg;

a manually-operable motor control device provided on the grip;

a display configured to display at least one of a target air pressure and an actual air pressure; and at least one operation button configured to set the target air pressure;

wherein the motor is configured to be driven in accordance with manual operation of the manually-operable motor control device;

the display and the at least one operation button are disposed on an operation part; and a line perpendicular to a rotational axis of an output shaft of the motor intersects the operation part, the compression mechanism and the at least one leg.

7. The inflator according to claim 5, further comprising:

the hose, wherein an end portion of the hose is connected to the attachment opening and is in fluid communication with the compression mechanism.

8. The inflator according to claim 7, wherein the hose protrudes from the attachment opening in a direction that is at least substantially parallel to the front-rear direction.

9. The inflator according to claim 8, further comprising:

a cover member that covers at least a portion of the hose adjacent to the attachment opening.

10. The inflator according to claim 9, wherein the cover member is helical shaped with a helical gap.

11. The inflator according to claim 1, wherein the grip is disposed at least substantially parallel to a rotational axis of the output shaft of the motor.

12. The inflator according to claim 1, wherein the motor, the compression mechanism, and the battery mount part are disposed between the grip and the lower surface of the at least one leg.

13. The inflator according to claim 1, wherein the battery mount part is configured such that the battery is mountable and removable by being slid in an up-down direction that is (i) orthogonal to a rotational axis of the output shaft of the motor and (ii) parallel to a line that intersects the grip and the motor.

14. The inflator according to claim 1, further comprising:

the hose, wherein an end portion of the hose is connected to the attachment opening and is in fluid communication with the compression mechanism; and the hose protrudes from the attachment opening in a direction that is at least substantially parallel to the front-rear direction.

15. The inflator according to claim 14, further comprising:

a cover member that covers at least a portion of the hose adjacent to the attachment opening.

16. The inflator according to claim 15, wherein the cover member is helical shaped with a helical gap.

17. The inflator according to claim 1, wherein the manually-operable motor control device is a trigger switch.

18. The inflator according to claim 6, wherein:

an attachment opening for a hose that guides compressed air discharged from the compression mechanism to an object to be inflated is provided on the main body housing; and the attachment opening and the battery mount part are located on opposite ends of the inflator in a front-rear direction that is parallel to the rotational axis of the output shaft of the motor.

19. A portable inflator, comprising:

a motor;

a compression mechanism driven by the motor and configured to compress and discharge air;

a main body housing that comprises a battery mount part, onto which a battery that serves as a power supply for the motor is mountable and from which the battery is dismountable, the motor and the compression mechanism being housed in the main body housing;

at least one leg configured to support the main body housing when a lower surface of the at least one leg is disposed on a surface;

a grip connected to the main body housing and extending at least substantially parallel to the lower surface of the at least one leg; and a manually-operable motor control device provided on the grip;

wherein the motor is configured to be driven in accordance with manual operation of the manually-operable motor control device; and a portion of the compression mechanism is located inside the at least one leg.

20. The inflator according to claim 19, wherein:

an attachment opening for a hose that guides compressed air discharged from the compression mechanism to an object to be inflated is provided on the main body housing; and the attachment opening and the battery mount part are located on opposite ends of the inflator in a front-rear direction that is parallel to a rotational axis of the output shaft of the motor.

21. A portable inflator, comprising:

a housing;

a battery mount provided at a first longitudinal end of the inflator and configured to mount a battery pack externally of the housing;

a motor disposed inside the housing;

a compressor disposed inside the housing and configured to be driven by the motor to compress and discharge air;

a first leg configured to support the housing when a lower surface of the first leg is disposed on a surface;

a grip connected to the housing and extending along a longitudinal axis that is at least substantially parallel to the lower surface of the first leg;

an opening provided at a second longitudinal end of the inflator that is opposite of the battery mount in a direction parallel to, or at least substantially parallel to, the longitudinal axis of the grip; and a hose extending from the opening and fluidly connected to a compressed air outlet of the compressor.

22. The portable inflator according to claim 21, wherein first and second ends of the grip are connected to the housing such that the grip and the housing together form a substantially D-shaped loop defining an elongated through-hole configured to receive fingers of a user's hand while the grip is being held by the user's hand.

23. The portable inflator according to claim 22, further comprising:

a display configured to display at least one of a target air pressure and a measured air pressure; and at least one button configured to set the target air pressure;

wherein the display and the at least one button are disposed on an outer surface of the inflator that: (i) is located between the elongated through-hole and the second longitudinal end of the inflator in a direction parallel to the longitudinal axis of the grip, and (ii) extends at least substantially parallel to the lower surface of the first leg.

24. The portable inflator according to claim 23, further comprising:

a second leg disposed between the elongated through-hole and the first longitudinal end of the inflator in a direction parallel to the longitudinal axis of the grip, the second leg having a lower surface;

wherein:

the first leg is disposed between the elongated through-hole and the second longitudinal end of the inflator in the direction parallel to the longitudinal axis of the grip; and the first leg and the second leg extend from the housing such that, when the lower surfaces of the first and second legs are disposed on the surface, a hollow gap is formed between a lower surface of the housing and the surface and extends in the direction parallel to the longitudinal axis of the grip.

25. The portable inflator according to claim 24, further comprising:

an operation part that contains the display and the at least one button;

wherein the operation part is intersected by a straight line that extends perpendicularly from a plane containing the lower surface of the first leg.

* * * * *